US005109776A

United States Patent [19]

Johnstone et al.

[11] Patent Number: 5,109,776

[45] Date of Patent: May 5, 1992

[54] GONDOLA TYPE RAILWAY CAR WITH SNUG FITTING CENTER PLATE ARRANGEMENT

[75] Inventors: Bradford Johnstone, Flossmoor, Ill.; Robert W. Lyons, Michigan City, Ind.

[73] Assignee: Trinity Industries Inc., Dallas, Tex.

[21] Appl. No.: 547,021

[22] Filed: Jun. 29, 1990

[51] Int. Cl.[5] ..... B61F 5/14

[52] U.S. Cl. ..... 105/199.3; 105/199.4; 105/200

[58] Field of Search ..... 105/199.1, 199.2, 199.3, 105/199.4, 200, 202, 203, 228, 453

[56] References Cited

U.S. PATENT DOCUMENTS

| | | | |
|---|---|---|---|
| 2,680,413 | 6/1954 | Becker | 105/199.2 X |
| 3,350,146 | 10/1967 | Williams | 105/200 X |
| 3,713,710 | 1/1973 | Wallace | 105/199.4 X |
| 3,797,674 | 3/1974 | Reynolds | 105/199.4 X |
| 3,889,607 | 6/1975 | Hassenauer | 105/199.2 |
| 3,961,584 | 6/1976 | Paton et al. | 105/199.1 X |
| 4,567,833 | 2/1986 | Hanson | 105/199.3 |

*Primary Examiner*—Robert J. Oberleitner
*Assistant Examiner*—S. Joseph Morano

[57] ABSTRACT

A railway car comprising a body and supporting truck the body having a rigid pin extending into a close-fitting socket in the truck bolster and the car body and truck bolster having close contact side bearings so that the car body and truck bolster sway essentially as a unit.

10 Claims, 4 Drawing Sheets

GONDOLA TYPE RAILWAY CAR WITH SNUG FITTING CENTER PLATE ARRANGEMENT

BACKGROUND OF THE INVENTION

This invention relates to railway cars and more specifically to gondola type cars which have high sides and primarily used to haul coal and the like and which are inverted to dump the lading.

The cars in previous use were heavy to obtain the necessary strength and required special gear to maintain stability. The conventional car utilizes a center plate and the body has a center pin which cooperates with the center plate in a loose fitting connection which demands typical side bearings to accommodate the fore and aft, lateral and turning movements between the car body and the supporting truck.

SUMMARY OF THE INVENTION

An object of this invention is to provide a novel car wherein the car body and truck comprise a novel interconnection which controls the transfer of loads in a close coupled arrangement.

A further object is to provide a novel car bolster connection comprising a close fitting center pin connection with the truck bolster, thereby maintaining the engagement between the body side bearing and the side bearings of a truck bolster against relative lateral and other shifting movements therebetween.

A still further object is to provide a car having a relatively light body bolster and center filler structure which has a fixed center pin fitting into a complemental opening in the truck bolster so that as the car body oscillates the truck bolster follows thus keeping the body side bearing in contact with the truck side bearing.

A different object is to provide a relatively lighter weight car in which the relatively movable parts are more close coupled than in conventional cars and thereby reduce impact loads therebetween.

The invention comprehends a body bolster and center filler arrangement wherein the side bearings on the car body are positioned beneath the side walls and sills of the car body and cooperate with side bearings positioned on end portions of the truck bolster outwardly of the side frames of the supporting truck.

A still further object is to provide a novel side bearing assembly in which the top body side bearing assembly is constituted of an aluminum structure having a flat horizontal face which seats against a stainless steel bearing pad, which abuts a lower bearing pad which has a spherical bottom rockably seated within a complimentary pocket formed in the upper end portion of the bottom bearing member carried by the truck bolster.

These and other objects and advantages inherent in and encompassed by the invention will become more apparent from the specification the drawings, wherein.

DESCRIPTION OF THE INVENTION

Figures 1, 2:
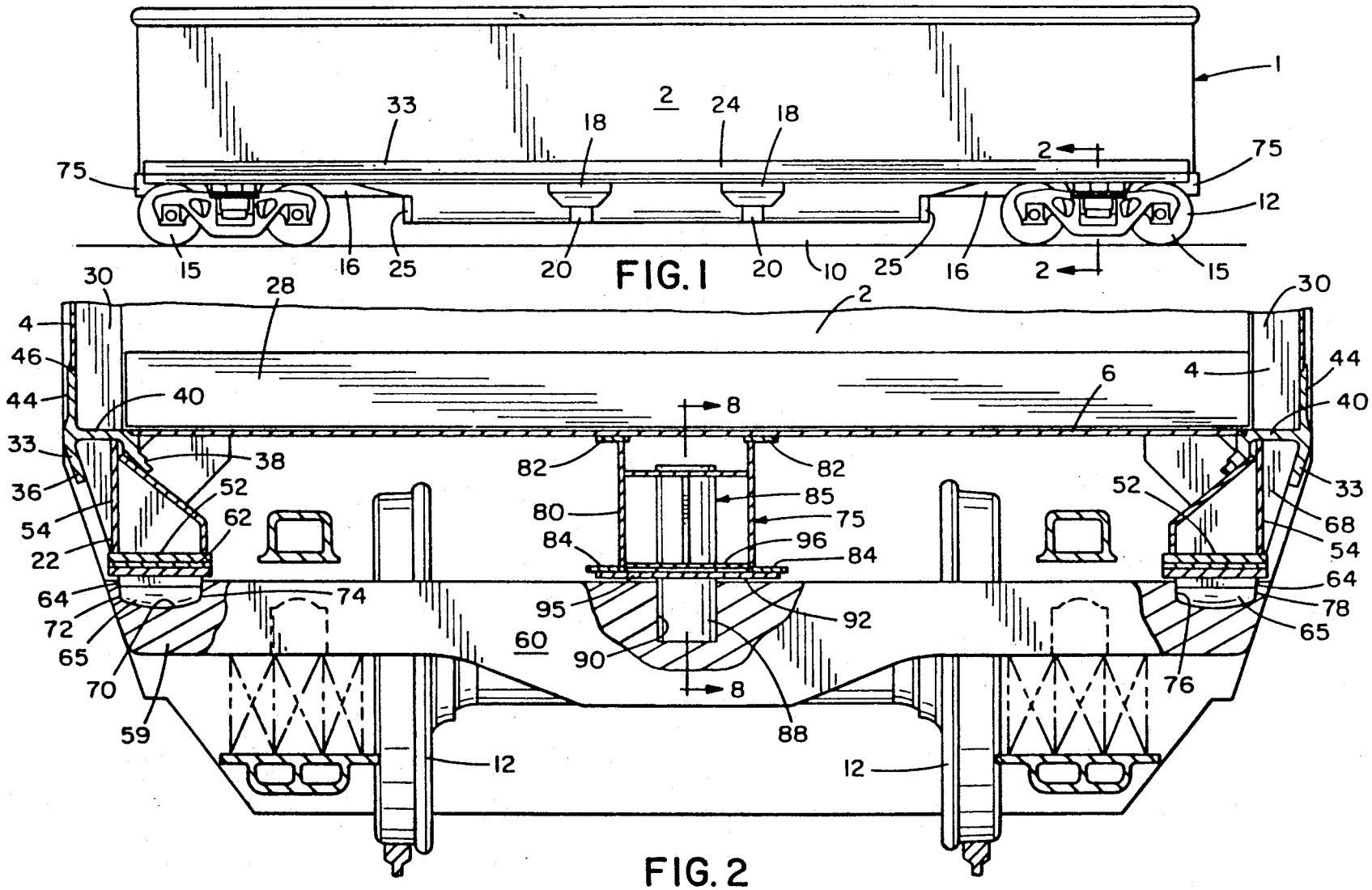
FIG. 1 is a side elevational view of a railway car incorporating the invention.
FIG. 2 is an enlarged cross-sectional view taken substantially on line 2—2 of FIG. 1.
Figure 3:
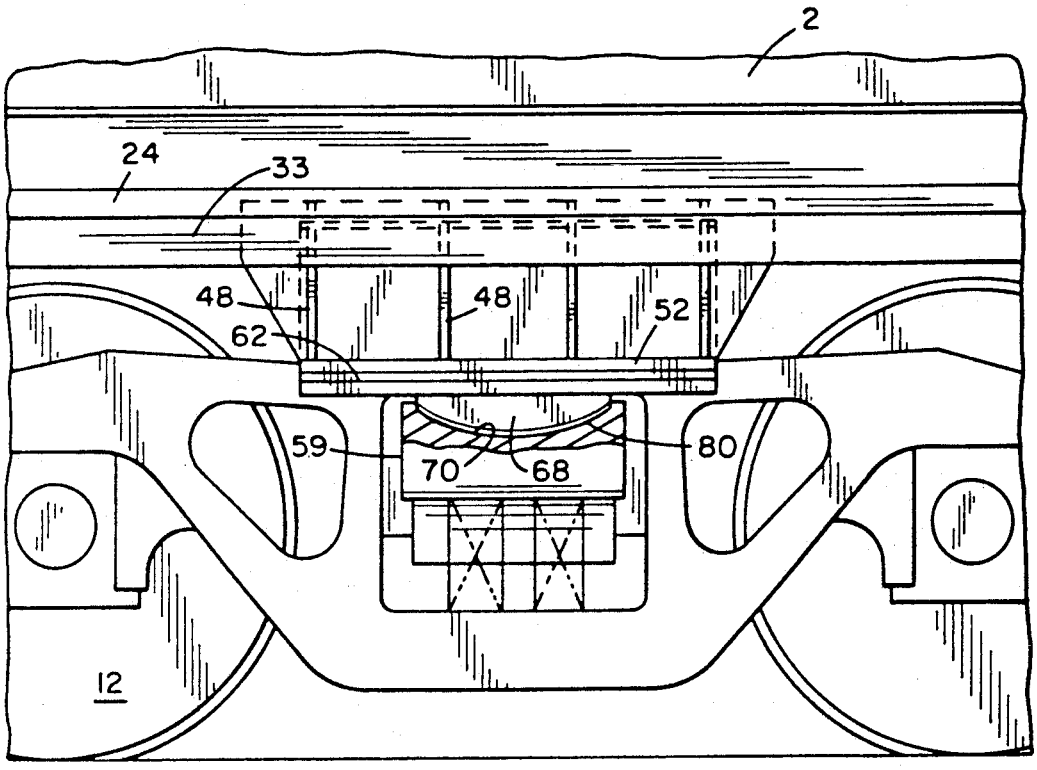
FIG. 3 is an enlarged fragmentary side elevational view of the car truck and parts of the car body.
Figure 4:
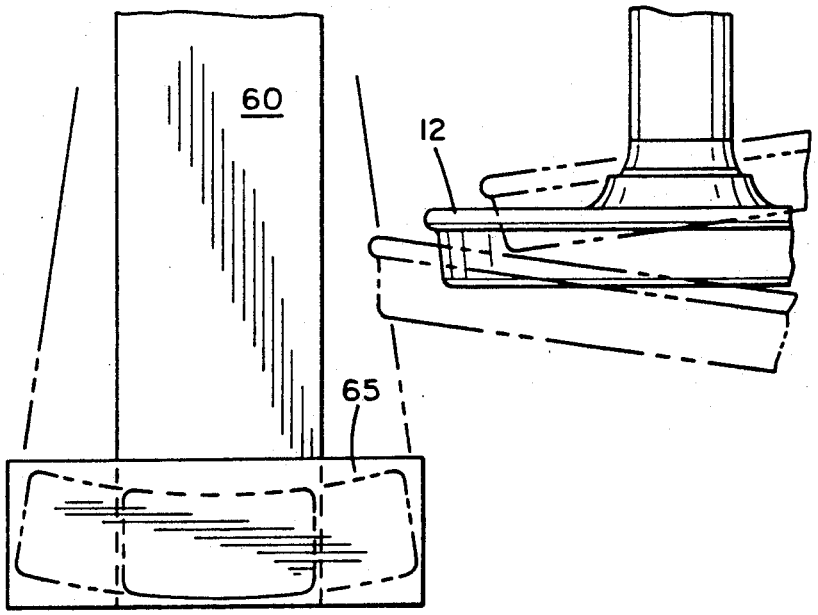
FIG. 4 is a top view showing the dynamics of operation of the wheel and bolsters and bearing structure.

Having reference to FIG. 1 of the drawings there is shown an aluminum high-sided gondola car generally designated 1 which comprises side and end walls 2 and 4 and a bottom 6 connected with side walls.

The bottom has a curved center portion 10 which extends below the upper portion of the wheels 15 of the trucks 12, 12 disposed beneath the ends portions 16, 16 of the car body.

Cross braces 18, 18 are provided each of which comprises a beam 20 passing under the arcuate bottom portion 10 and are connected at each end to a bracket which may be a casting or fabrication which is connected to the lower edge portion 24 of the side wall.

The ends of the center portion of the floor are closed by upright walls 25, 25 which are connected with flat horizontal end floor sections 16, 16 which extend from the upper ends of the end wall portion 25 between the side walls of the car and connected therewith as best seen in FIG. 2.

There are provided transverse beams or body bolsters 28 seated and connected with the floor sections 16. The beams 28 are connected at their ends to the interior of the upright posts 30 which are connected to the side walls of the car against the interior surface thereof.

The car is provided on each side thereof with an aluminum longitudinal side sill 33 extending the length of the car.

The side sill is a downwardly open channel section comprising a pair of laterally spaced legs 36, 38 and an integral upper interconnecting web 40. Web 40 has an inner edge portion 42 extending beneath and joined to an overlying portion of the related end floor section 6 and connected therewith at 41.

The side sill further has an upwardly extending leg 44 which at its upper edge is connected at 46 to the lower edge of the associated side wall panel 4.

The upper side bearing bracket 22 has an inner plate 45, which depend from the side bearing legs 38 and is connected thereto and extends diagonally downwardly inwardly from the respective side of the car. A plate 48 spans the space between the top of the inner plate 45 and the bottom of the floor and is welded thereto.

Figure 5:
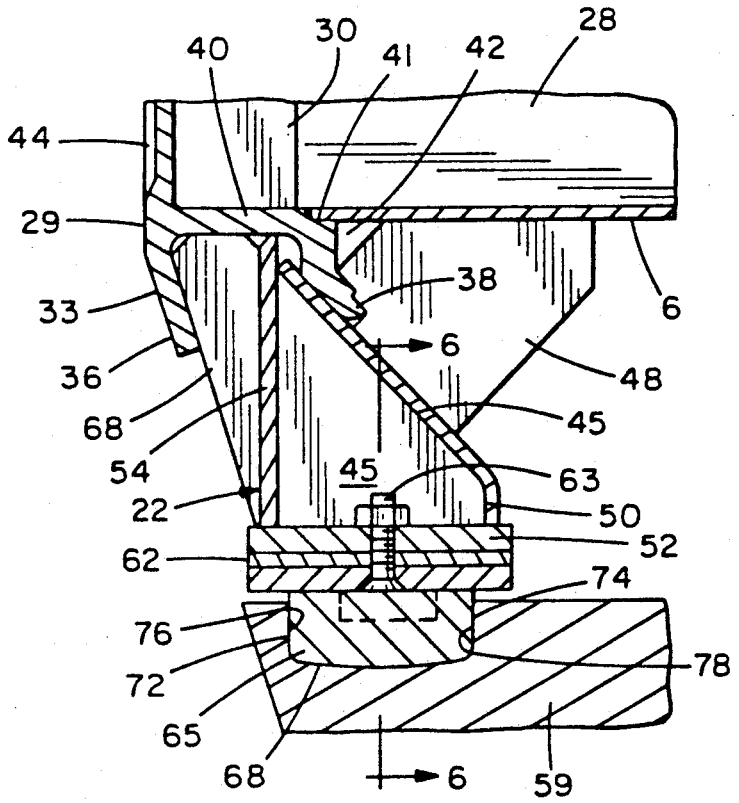
FIG. 5 is an enlarged cross-sectional view bearing portion shown on FIG. 2.
Figure 6:
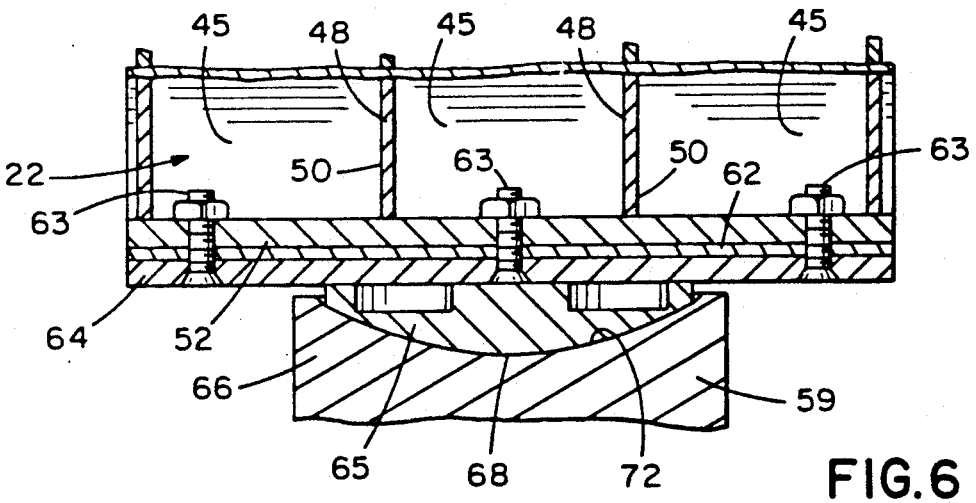
FIG. 6 is a cross-sectional view taken substantially on line 6—6 of FIG. 5.
Figure 7:
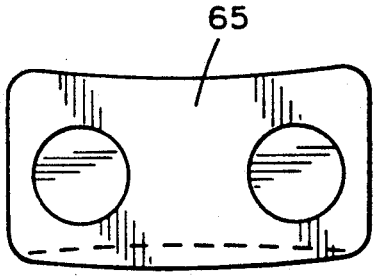
FIG. 7 is a side elevation of a bearing plate assembly.
Figure 8:
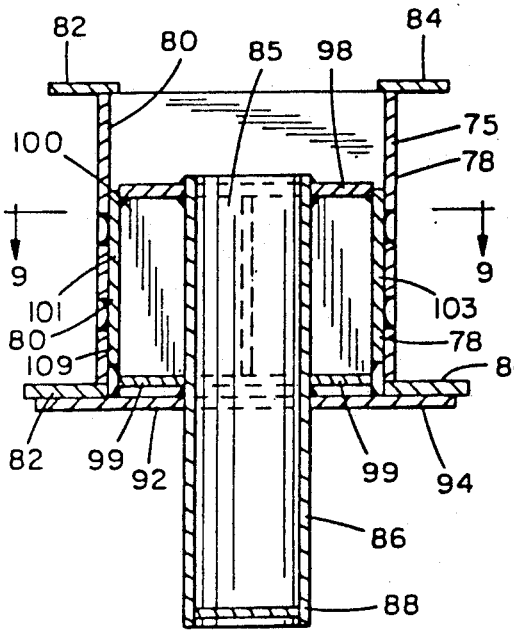
FIG. 8 is an enlarged vertical sectional view taken substantially on line 8—8 of FIG. 2.

The inner plate 48 has an integral vertical lower portion 50 (FIG. 5) and the lower ends of the inner webs 45, are welded to an aluminum horizontal base plate 52. The base plate 52 is welded to the lower edge of a vertical outer plate said plate 54 has its upper edge connected to the underside of the cross-web 40 of the side sill. A plurality of triangular gussets 68 are positioned between the lower side of plate 54 and is welded thereto. Plates or gussets 68 are spaced longitudinally of the car.

The bearings are offset inwardly of the sides of the cars over the end portions 59 of the spring truck bolster 60 of truck 15.

The base plate or mounting disk 52 seats upon a steel or aluminum shim 62 and is connected therewith with a stainless steel wear plate 64 by bolt and nut assemblies 63, 63. Plate 64 engages the top surface of a top plate 65 of the truck bolster side bearing assembly which comprises a body portion 66 with a spherical bottom surface 68 which is disposed or applied against a complimentary bottom upwardly facing surface 70 of a bolster pocket 72. The bearing rocks upon surfaces 70, 68. The lower bearing body has flat inboard and outboard sides 72, 74 which fit snugly against the opposing parallel sides 76, 78 of the pocket.

The stub center sills 75 at opposite ends of the cars mounting couplers 73 and have a pair of side walls 79, 80 and outturned top and bottom flanges 82, 84 at the upper and lower ends of walls 79, 80.

The upper flanges are connected to several internal cross-beams 28 and floor bottom sections 26.

A center pin assembly 85 is provided within each stub sill and comprises a hollow vertical pin 86, which has a lower end portion 88 which fits closely complementally into a close or snug fitting socket or bore 90 in the truck bolster.

Figure 9:
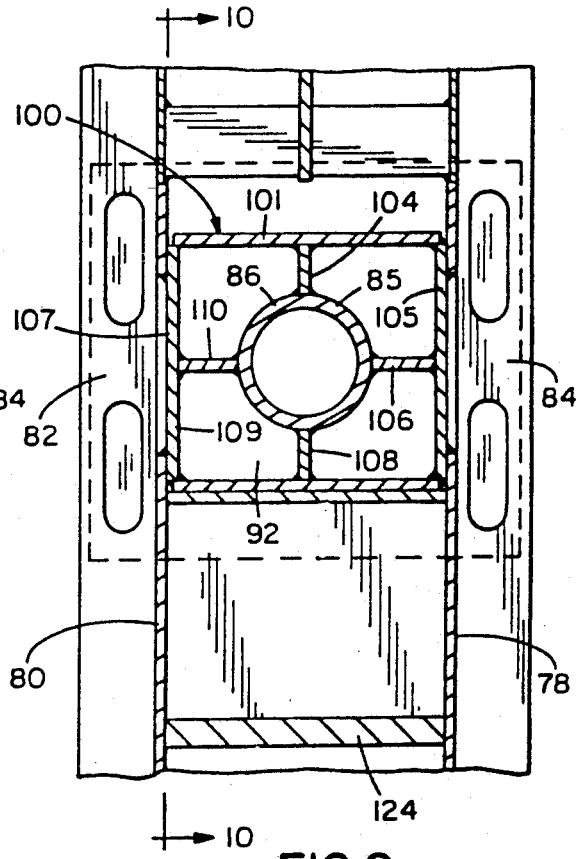
FIG. 9 is a horizontal cross-sectional view taken substantially on line 10—10 of FIG. 8.
Figure 10:
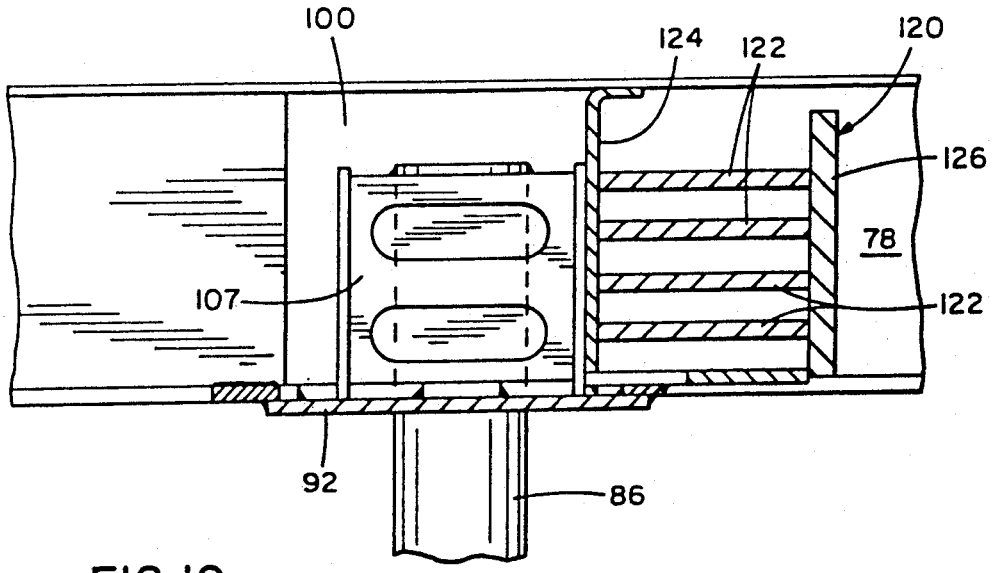
FIG. 10 is a vertical sectional view taken substantially on line 10—10 of FIG. 9.

The pin is ensleeved by a wear plate 92 which bears on its lower side 94 against an upper side 95 of the truck bolster wear plate. The pin extends into apertures in upper and lower plate braces 98, 99 which fit within an encasement 100 of square cross-section as seen in FIG. 9. The encasement or housing 100 has its side walls 101, 103, bearing against the side walls of the center sill and are welded thereto.

Vertical connecting webs 104, 106, 108 and 110 in a crusiform arrangement are positioned about the center pin. Web 104 is welded to the casing wall 101 and to the pin, web 106 is welded to the pin and wall 105 web 108 is welded to the pin and to wall 107 and web 110 is welded to the pin and wall 109.

As best seen in FIG. 9 walls 102 and 105 are welded to walls 80, 79 of the center sill.

Adjacent to the pin within the center sill there is provided a buffer plate assembly 120 which comprises a series of vertical spaced horizontal plates 122 which are connected at their edges to the side walls 79, 86 of the center sill and to vertically cross-plates 124, 126 which at their lateral edges are connected to the sidewalls of the center sill.

The foregoing structure provides a strong mutually supporting integrated assembly for accommodating shock loads transmitted to the framework.

It will be apparent that the snugly fitting center pin allows the body to roll in unison with the truck bolster thereby maintaining constant contact between the side bearings and thus controlling relative swaying between the body and the truck bolster.

What is claimed is:

1. A railway car comprising:

a car body having side sills;

supporting trucks for said car body, each truck having side frames and a transverse bolster having end portions projecting outwardly of said truck side frames, each bolster end portion having an upwardly opening bearing socket with a spherical bottom surface;

upper bearing brackets elongated transversely of said truck bolster and having a plurality of spaced vertical webs connected at their upper ends to the respective side sill and a flat bottom face; and for each bearing bracket, a bearing block having a flat top surface engaging said bracket bottom face and a spherical bottom face complementary to and engaging the corresponding one of said bearing sockets of said bolsters.

2. A railway car comprising:

a car body having side sills, a bottom defining a wall with associated portions of the car, and a transverse beam within the wall;

supporting trucks for said car body, each truck having side frames and a transverse bolster having end portions projecting outwardly of said truck side frames, each bolster end portion having an upwardly opening bearing socket with a spherical bottom surface;

upper bearing brackets each comprising a skeletal structure depending from the bottom of a respective side sill and connected to said transverse beam and;

for each bearing bracket, a bearing block mounted on the lower end of said bracket, each bearing block having a spherical bottom face complementary to and engaging the corresponding one of said bearing sockets of said bolsters.

3. A railway car comprising:

a car body having side sills;

supporting trucks for said car body, each truck having said frames and a transverse bolster having end portions projecting outwardly of said truck side frames, each bolster end portion having an upwardly opening bearing socket with a spherical bottom surface;

upper side bearings each including a bracket depending from said side sill, each of said brackets having a flat bottom face;

for each bearing bracket, a bearing block having a flat top surface engaging said bracket bottom face and a spherical bottom face complementary to and engaging the corresponding one of said bearing sockets of said bolster;

said railway car being further characterized in that:

said body includes a body bolster and center filler structure overlying said truck bolster and having a center pin rigidly secured thereto; and said truck bolster includes a socket snugly fitting said pin therein whereby said body and truck bolster are in close coupled relation with each other and motions of the body correspond with the motions of the truck bolster.

4. In a railway car having a car body with a transverse bolster and center filler structure, a railway truck having a spring supported truck bolster positioned beneath said body bolster, said body bolster having a center pin depending therefrom, and said truck bolster having a snugly fitting socket recessed therein holding said pin whereby said body and said truck bolster are in close coupled relation with each other and whereby motions of the body correspond with the motions of the truck bolster.

5. A railway car comprising a car body having side walls and a supporting railway truck having side frames and a spring-mounted bolster thereon, said car body having a pair of laterally spaced side bearings offset inwardly from said side walls, said body having a rigid fixed depending center pin, and said bolster having a center socket snugly receiving said pin therein in close coupled relationship therewith whereby said body and bolster move correspondingly, center bearing means sleeved on said pin and rigidly held thereon.

and socket bearing means about said socket in engagement with said center bearing means on the pin.

6. The invention according to claim 5, and opposing bearing means on the truck bolster and body side bearing closely spaced to each other for minimizing opposing moments therebetween.

7. The invention according to claim 6, and said body having an inverted U-shaped sill including a pair of side flanges angled inwardly from the sides of the car body, means providing a backing for said flanges from portions of the car body thereabove, and means providing side bearing supports from said sill, and bearings on said supports having an arcuate conformation about the axis of the pin.

8. The invention according to claim 7, and said body comprising a center sill and said pin being connected to the center sill.

9. The invention according to claim 8, and said center sill comprising a stub sill at each end of the car and each said stub sill comprising a buffer reinforcement, and a coupler at the outer end of each center sill.

10. The invention according to claim 5, and a cross-member extending between the side walls and connected therewith and with said side bearings.

* * * * *